US009046254B2

(12) United States Patent
Bedard et al.

(10) Patent No.: US 9,046,254 B2
(45) Date of Patent: Jun. 2, 2015

(54) LIGHT FIXTURE AND METHOD OF DECORATING A LAMP

(76) Inventors: Shannon Colleen Bedard, Bermuda Dunes, CA (US); Craig Matthew Bedard, Bermuda Dunes, CA (US)

( * ) Notice: Subject to any disclaimer, the term of this patent is extended or adjusted under 35 U.S.C. 154(b) by 700 days.

(21) Appl. No.: 12/460,564

(22) Filed: Jul. 21, 2009

(65) Prior Publication Data

US 2010/0020555 A1 Jan. 28, 2010

Related U.S. Application Data

(60) Provisional application No. 61/082,734, filed on Jul. 22, 2008.

(51) Int. Cl.
*F21V 11/00* (2006.01)
*F21V 21/02* (2006.01)
*F21S 8/00* (2006.01)

(52) U.S. Cl.
CPC *F21V 21/02* (2013.01); *F21S 8/033* (2013.01)

(58) Field of Classification Search
CPC ..... F21S 2/00; F21V 1/00; F21V 15/00
USPC ..... 362/432, 351, 253, 147
See application file for complete search history.

(56) References Cited

U.S. PATENT DOCUMENTS 4,217,629 A * 8/1980 Russell ..... 362/147
4,999,754 A * 3/1991 Gary ..... 362/237
5,622,424 A * 4/1997 Brady ..... 362/644
5,924,789 A * 7/1999 Thornton ..... 362/370
6,811,281 B1 * 11/2004 Hsiao ..... 362/641
7,188,976 B1 * 3/2007 Fung ..... 362/351
7,354,177 B2 * 4/2008 Wilcox et al. ..... 362/297
7,631,982 B1 * 12/2009 D'Onofrio ..... 362/151
7,744,232 B2 * 6/2010 Gruenbacher et al. ..... 362/96
2001/0033487 A1 * 10/2001 Crelin ..... 362/147
2007/0263396 A1 * 11/2007 Miller ..... 362/432

OTHER PUBLICATIONS

Website (Unknown author, publisher, or publication date): http://www.earthstudiomoab.com/home/es2/smartlist_25/outdoor_sconce_covers.html.
Website (Unknown author, publisher, or publication date): http://store.starrynightlights.com/spj36-11-dl.html.

* cited by examiner

*Primary Examiner* — Anh Mai
*Assistant Examiner* — Jessica M Apenteng
(74) *Attorney, Agent, or Firm* — Fernando Hale & Chang LLP

(57) ABSTRACT

A method of decorating a lamp extending from a vertical wall includes providing a light fixture, the light fixture having a surface comprising a first edge and a second edge and a bracket connected to the surface, the bracket having a notch. The lamp has an arm portion and a light portion, the light portion having a larger cross section than the arm portion. The method includes placing the light fixture over the lamp and mating the bracket with the arm portion so that the arm portion fits within the notch, where the light fixture is supported at least by contact between the notch and the arm portion, contact between the first edge and the wall, and contact between the second edge and the wall.

17 Claims, 3 Drawing Sheets

LIGHT FIXTURE AND METHOD OF DECORATING A LAMP

REFERENCE TO RELATED APPLICATIONS

The present application claims priority to U.S. Provisional Patent Application No. 61/082,734, filed Jul. 22, 2008, entitled "Bracketed Light Sconce."

BACKGROUND

Sconces and outdoor electric light fixtures have been used to provide fashionable and high-quality outdoor lighting. They often cover a light source, allowing light to emanate only from above and below, so as to reduce light pollution.

SUMMARY OF THE INVENTION

Problems with existing sconces are that they are expensive, they must be permanently mounted to a wall using screws, nails, anchors, etc., they are not easily replaceable or interchangeable, and they are not readily adjustable. There is a need for sconces or light fixtures that can be easily mounted, removed, interchanged, and easily adjusted. The present invention aims to solve one or more of these and other problems.

In one embodiment of the present invention, a method of decorating a lamp extending from a vertical wall comprises: providing a light fixture, the light fixture comprising: a surface comprising a first edge and a second edge; and a bracket connected to the surface, the bracket comprising a notch, wherein the lamp comprises an arm portion and a light portion, the light portion having a larger cross section than the arm portion; placing the light fixture over the lamp; and mating the bracket with the arm portion so that the arm portion fits within the notch, wherein the light fixture is supported at least by: contact between the notch and the arm portion; contact between the first edge and the wall; and contact between the second edge and the wall.

In one aspect, the providing may further comprise: querying a customer regarding a desired personalization of the light fixture; and producing the light fixture with the desired personalization.

In one aspect, the light fixture is neither permanently attached to the lamp nor the wall, whereby the light fixture is configured to be removed from the lamp and wall by lifting the light fixture so that the arm portion is no longer within the notch.

In one aspect, the surface is curved. In one aspect, the light fixture has a cross section of a partial circle. In one aspect, the bracket comprises a flat metal strip extending between the first and second edges.

In one aspect, the method further comprises: removing the light fixture from the lamp and wall by lifting the light fixture so that the arm portion is no longer within the notch; providing a second light fixture, the second light fixture comprising: a second surface comprising a third edge and a fourth edge; and a second bracket connected to the second surface, the second bracket comprising a second notch; placing the second light fixture over the lamp; and mating the second bracket with the arm portion so that the arm portion fits within the notch, wherein the second light fixture is supported at least by: contact between the second notch and the arm portion; contact between the third edge and the wall; and contact between the fourth edge and the wall.

In one aspect, the first and second edges are substantially linear and parallel, and the method further comprises adjusting the bracket so that when the bracket is mated with the arm portion, the first and second edges are substantially parallel with the wall. In one aspect, the adjusting comprises bending the bracket.

In one aspect, the light fixture is neither permanently attached to the lamp nor the wall, whereby the light fixture is configured to be removed from the lamp and wall by lifting the light fixture so that the arm portion is no longer within the notch, the first and second edges are substantially linear and parallel, and the method further comprises: adjusting the bracket so that when the bracket is mated with the arm portion, the first and second edges are substantially parallel with the wall; removing the light fixture from the lamp and wall by lifting the light fixture so that the arm portion is no longer within the notch; providing a second light fixture, the second light fixture comprising: a second surface comprising a third edge and a fourth edge; and a second bracket connected to the second surface, the second bracket comprising a second notch; placing the second light fixture over the lamp; and mating the second bracket with the arm portion so that the arm portion fits within the notch, wherein the second light fixture is supported at least by: contact between the second notch and the arm portion; contact between the third edge and the wall; and contact between the fourth edge and the wall.

In one embodiment of the present invention, a light fixture comprises: a curved surface comprising: first and second edges that are substantially linear and parallel; and upper and lower edges; a bracket comprising: a flat metal strip extending between the first and second edges closer to the upper edge than the lower edge; and a curved notch located centrally along a length of the flat metal strip, wherein the notch is located approximately two to four inches from an inside surface of the curved surface, and wherein the notch is shaped and located to rest on an arm portion of a lamp extending from a vertical wall.

DETAILED DESCRIPTION

In the following description, the use of "a," "an," or "the" can refer to the plural. All examples given are for clarification only, and are not intended to limit the scope of the invention.

Figure 1:
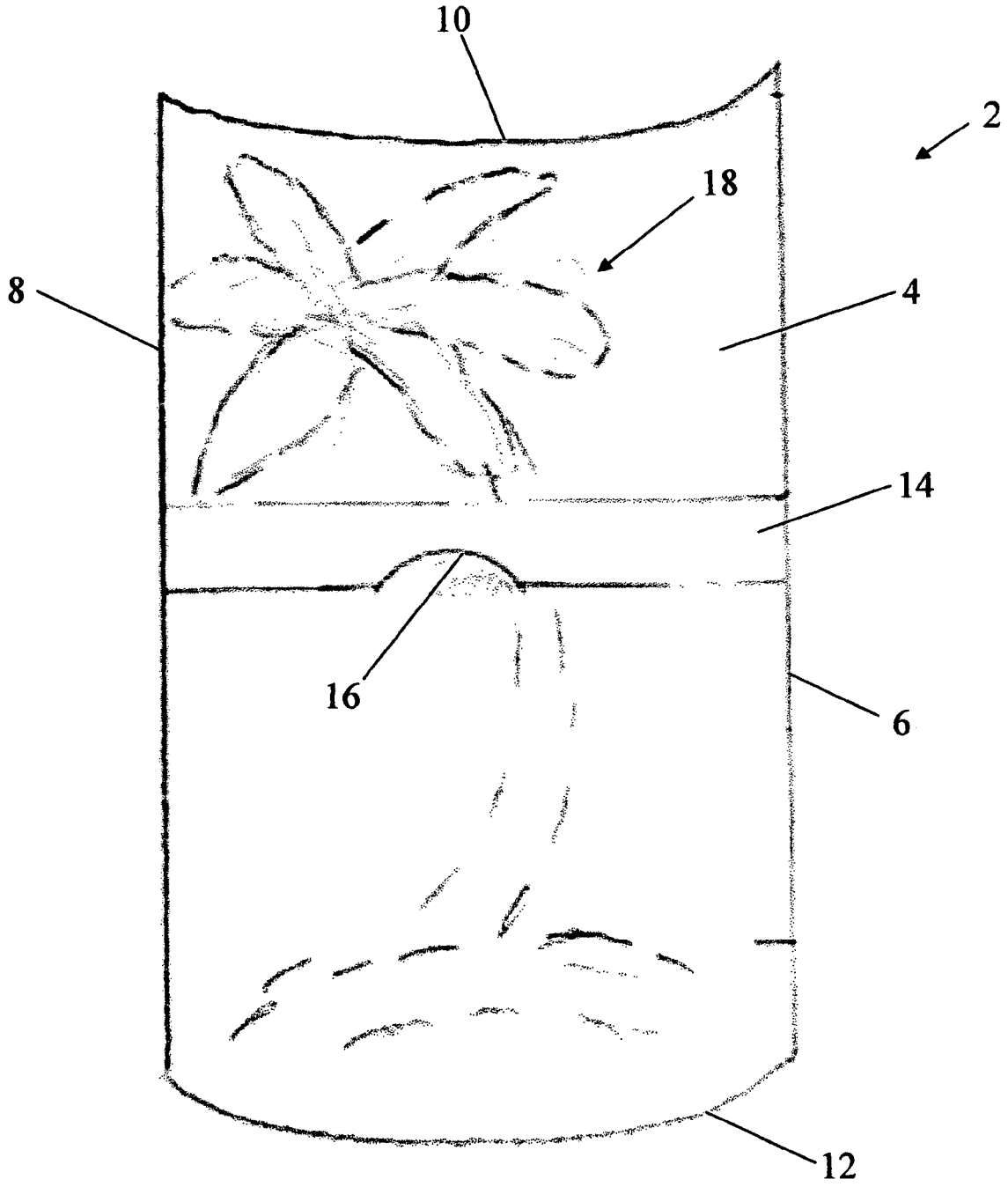
FIG. 1 shows an upward perspective view of the back of a light fixture according to an embodiment of the present invention.

Referring now to FIG. 1, a light fixture 2 comprises a surface 4 comprising a first edge 6, a second edge 8, an upper edge 10, and a lower edge 12. The light fixture 2 further comprises a bracket 14 connected to the surface 4, the bracket 14 comprising a notch 16. The surface 4 may comprise a decoration 18.

The surface 4 may comprise any hard material, including metal, ceramic, plastic, glass, and so forth. In one preferred aspect, the surface 4 comprises a powder coated steel, and may be any color. The surface 4 may have any cross sectional shape, such as a portion of a square, triangle, circle, oval, etc., and is preferably curved. As shown in FIG. 1, the surface 4 has a cross section of a partial circle, and may be formed by bending, curving, or warping an otherwise flat sheet of metal.

The decoration 18 may be etched or perforated into the surface 4 (by any known method, including but not limited to laser etching), or may simply be drawn, painted, inscribed, etc. In the embodiment in which the decoration 18 is perforated, light will shine through the holes when the light fixture 2 is mounted over the lamp (discussed later), creating a beautiful and desirable lighting effect. The decoration 18 shown in FIG. 1 shows a palm tree shaped perforation in the curved surface 4, although any known shape, design, or method of formation or application is within the scope of the present invention.

First and second edges 6, 8 are shown in FIG. 1 as being substantially straight and parallel to each other, although they may be curved, not parallel, etc. While surface 4 may be formed by curving an otherwise flat rectangular piece of metal (which may have a length and width each of between 12 and 24 inches, more preferably between about 16 and 20 inches), it may alternatively be formed from a flat piece of metal of any shape, including a triangle, a circle, a polygon (e.g., hexagon); further, the dimensions, shape, curvature, and parallelism (or lack thereof) of edges 6, 8 are not limited to that shown in the drawings. Upper and lower edges 10, 12 are shown to be curved (corresponding to the curvature of surface 4) and substantially parallel to each other. Similarly, the dimensions, shape, curvature, and parallelism (or lack thereof) of edges 10, 12 are not limited to that shown in the drawings.

Bracket 14 is shown in FIG. 1 extending between first and second edges 6, 8. It may comprise a flat strip made, e.g., of metal (or any other hard substance), preferably having a width of between one and three inches, more preferably around two inches. Bracket 14 comprises a notch 16 located approximately in the center of the flat strip (or at or above the center of gravity of the light fixture 2). The notch 16 may have any shape, such as a semi- or partially-circular or curved cutout, a triangular notch, a rectangular notch, an oval notch, and so forth, but preferably corresponds to a cross section of an arm portion 22 of a lamp (as will be discussed with respect to FIG. 2). The notch 16 is located along a lower edge of the flat strip and relative to the mass of the light fixture 2 such that the center of gravity of the light fixture 2 is below the notch 16, so that the light fixture 2 can be stably hung at the point of the notch 16.

The bracket 14 may be substantially straight, as shown in FIG. 1, or bent or curved, such as in the shape of a loop or inverted "V" that starts at a lower portion of first edge 6 and ends at a lower portion of second edge 8, or any other configuration, so long as the notch 16 is located above the fixture's center of gravity. In FIG. 1, bracket 14 (as a straight flat strip) is shown located above a center of edges 6, 8, toward and closer to the upper edge 10 than the lower edge 12, so as to ensure that notch 16 is above the fixture's center of gravity. For instance, the bracket 14 may be located about two to five inches from the upper edge 10, more preferably between about three and four inches.

Bracket 14 need not be attached directly to edges 6, 8, but is preferably located between edges 6, 8. For example, ends of bracket 14 may be attached to the inside surface of surface 4. Because bracket 14 extends across the curvature of surface 4, there is a distance between a center of the flat strip (where the notch 16 is located) and an inside surface of the surface 4. The notch 16 may be located approximately two to four inches from the inside surface of the surface 4, more preferably around three inches. The notch 16 may be shaped and located to rest on an arm portion 22 of a lamp (as discussed with respect to FIG. 2).

Bracket 14 preferably comprises a flexible or bendable material, such as metal, so that it is adjustable. Bracket 14 may, for instance, comprise a wire or other flexible material instead of a flat strip. As will be discussed with reference to FIG. 3, use of a flexible material allows the bracket to be bent or deformed so as to allow the light fixture 2 to better conform to and fit over the lamp.

Figure 2:
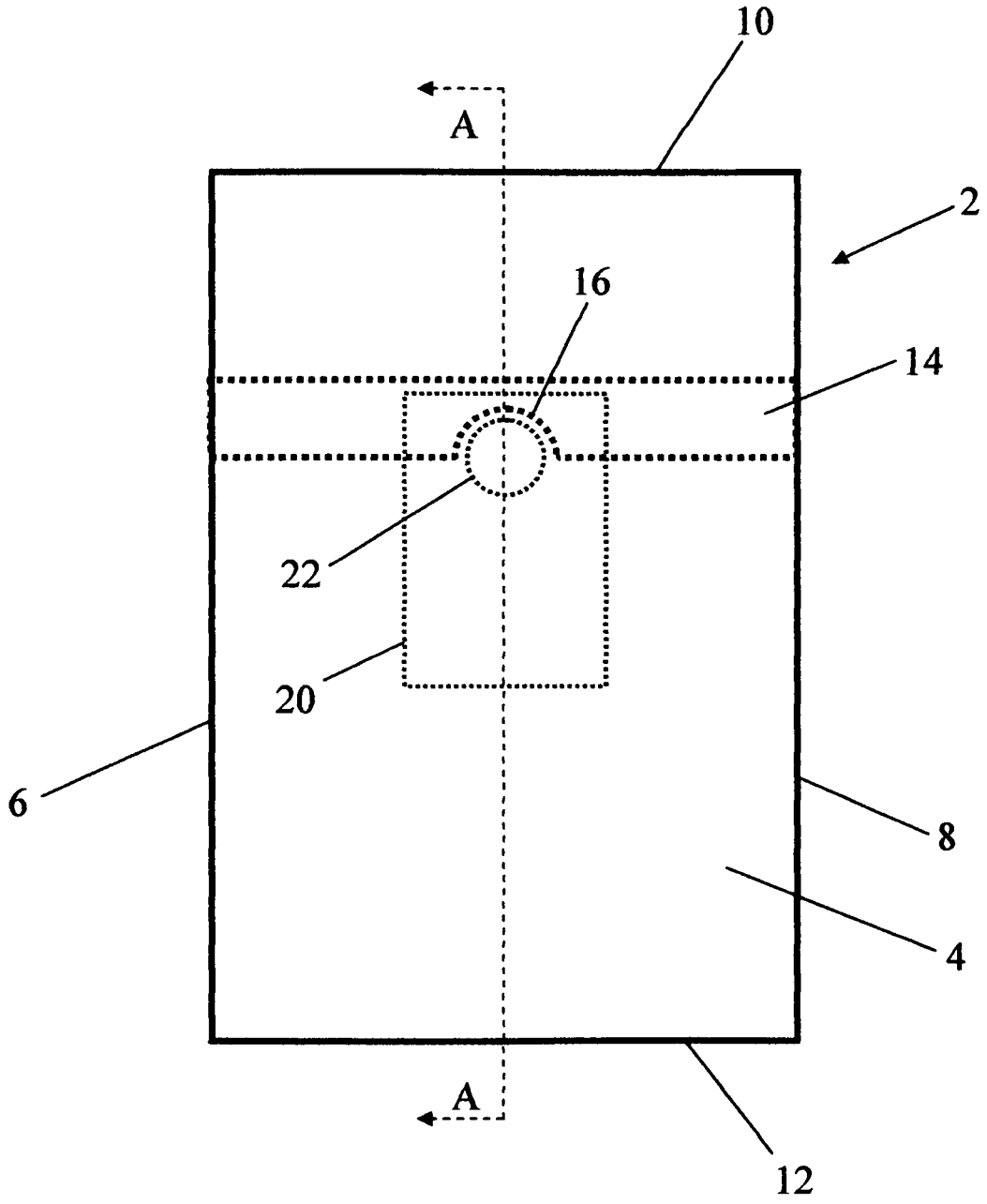
FIG. 2 shows a front view of a light fixture mated to a lamp extending from a vertical wall, according to an embodiment of the present invention.
Figure 3:
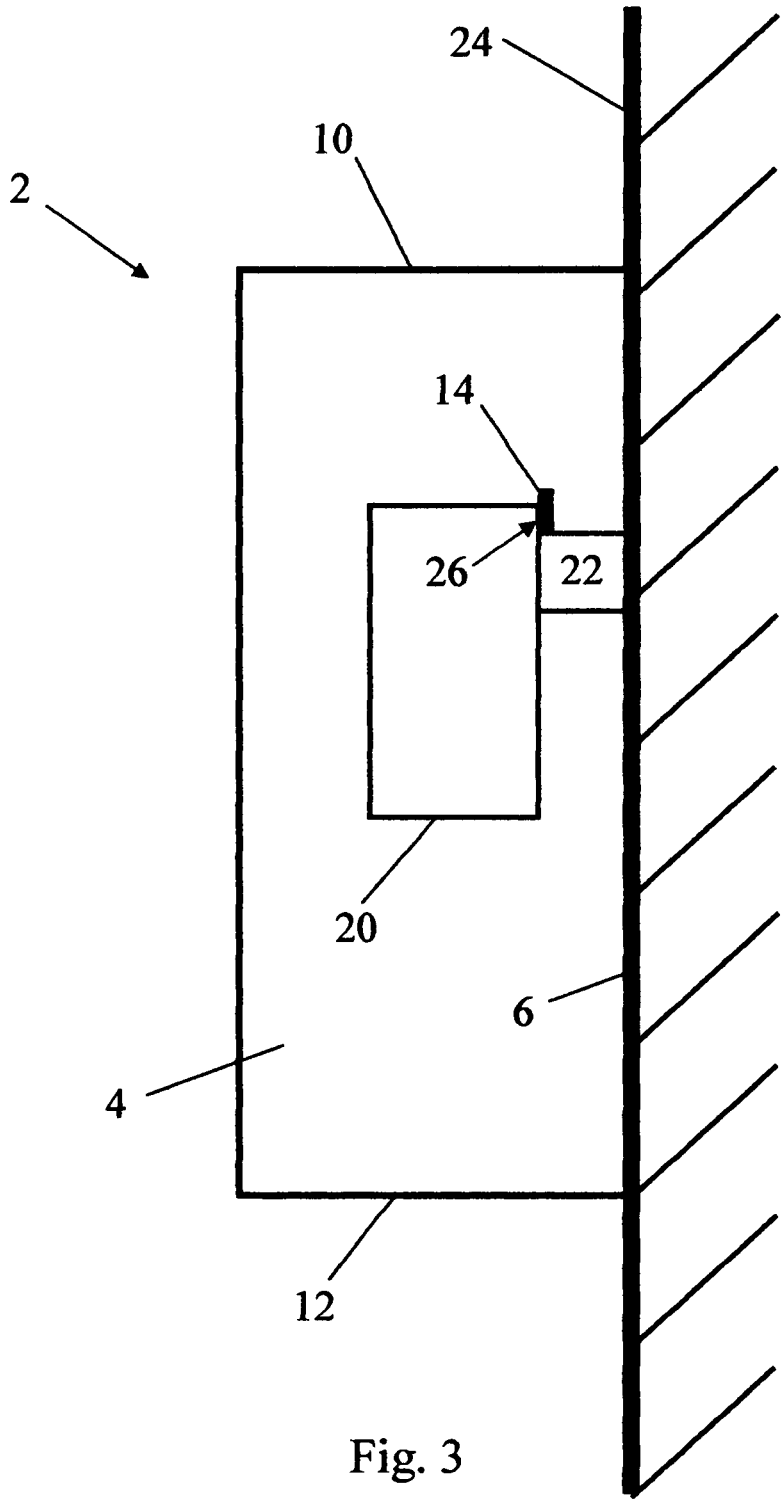
FIG. 3 shows a cross sectional view along section A-A shown in FIG. 2.

Referring now to FIGS. 2 and 3, the light fixture 2 shown in FIG. 1 is mated to a lamp extending from a vertical wall 24, such as the exterior wall of a house or building. The lamp comprises an arm portion 22 and a light portion 20, the light portion 20 having a larger cross section than the arm portion 22. For instance, the lamp may include an inexpensive outdoor lamp colloquially called a "jelly jar light," because the light bulb providing the illumination is shrouded by a glass shield that resembles a jar for holding jellies. The present invention is not limited to such lamps, and includes any lamp that extends from a vertical wall (often a home's or building's exterior lamp) that has a light portion, including a light bulb or other illumination source (not shown in the drawings), and an arm portion from which the light portion extends outward, where the arm portion has a smaller dimension or cross section than the light portion. For instance, as clearly shown in FIGS. 2 and 3, the light portion 20 has a larger cross section than the arm portion 22, so that the bracket 14 can fit over the light portion 20 and the notch 16 can (preferably snugly and without wiggle room) fit over the arm portion 22; thus, the larger dimension/size of the light portion 20 will prevent the light fixture 2 from falling off the lamp.

When the bracket 14 is mated with the arm portion 22 so that the arm portion 22 fits within the notch 16, the light fixture 2 is supported at least by: contact between the notch 16 and the arm portion 22; contact between the first edge 6 and the wall 24; and contact between the second edge 8 and the wall 24, although other points of contact are also possible between the light fixture 2 and the lamp and/or wall 24. If the light fixture 2 is only loosely mated with the lamp (such as if the bracket 14 is not adjusted for a tighter fit, as will be discussed later), then it is possible that only the bottom regions or points of first and second edges 6, 8 will contact the wall 24, with the weight of the light fixture 2 largely supported by contact between the notch 16 and arm portion 22.

For instance, in the embodiment shown in FIG. 3, the bracket 14 abuts against the back edge 26 of light portion 20 while arm portion 22 stably rests within notch 16. The bracket 14 may be bent or adjusted so that bracket 14 presses against the back edge 26 of light portion 20 such that substantially the entirety of straight edges 6, 8 contact the wall 24, as shown in FIG. 3. In other words, the bracket 14 may be bent or adjusted so that a cross sectional distance between the notch 16 and the first and second edges 6, 8 corresponds to a horizontal length of the arm portion 22. This provides a stable, upright, and quasi-permanent appearance to the light fixture 2. Any other known method of adjusting the bracket 14 so that first and second edges 6, 8 are substantially parallel to the wall 24 when the light fixture 2 is mated to the lamp is within the scope of the present invention.

In operation, a user will provide the light fixture 2, place the light fixture 2 over the lamp, and mate the bracket 14 with the arm portion 22 of the lamp so that the arm portion 22 fits within the notch 16, where the bracket 14 is prevented from moving past the light portion 20 because the light portion 20 has a larger cross section than the arm portion 22 and, more particularly, the notch 16. In one aspect, the user may adjust the bracket 14 so that the light fixture 2 is more vertical and, more specifically, the first and second edges 6, 8 are vertical and preferably substantially parallel to (and preferably entirely in contact with) the vertical wall 24. This may take several iterations as the user initially bends the bracket 14 too much or not enough, attempts to mate the bracket 14 with the arm portion 22, and then tries again, until the bracket 14 is properly adjusted.

An advantage to the light fixture 2 according to the present invention is that it may be readily mated/attached to, as well as readily removed/detached from, the lamp without the permanence provided by screws, nails, anchors, and so forth. Further, differing light fixtures 2 with different colors, decorations 18, and such may be interchanged, swapped, and so forth, depending on the user's preference, holidays, seasons, etc. Thus, the method according to the present invention may further include providing several light fixtures 2 that differ in design, shape, color, decoration 18, and so forth, and then alternately mating them to the lamp. The user may remove a first light fixture 2 from the lamp and wall 24 by lifting it upward and then away from the lamp and wall 24, and then replacing it with a second light fixture.

Another advantage to the light fixture 2 according to the present invention is that because it is not permanently mounted to either the lamp or the wall 24 using conventional mounting implements, it is easily removed simply by lifting the light fixture 2 so that the arm portion 22 is no longer within or mated to the notch 16.

The method may further include providing personalized light fixtures for a consumer or customer. For instance, a decoration 18 on a light fixture 2 may include a customer's name, home address, personalized design, and so forth. A manufacturer may query the customer regarding a desired personalization, and then may produce the light fixture 2 according to or with the desired personalization.

The examples described herein are not intended to limit the scope of the present invention. Most of the embodiments described herein have represented simple versions for clarity of explanation. Many of the features of the embodiments described herein may be "mixed and matched" to satisfy individual design requirements, and the present invention includes all such variations to the extent possible.

The applicant includes the following additional aspects and embodiments as within the scope of the present invention.

The present invention relates to a bracketed light sconce. The invention comprises a metal bracket 14, which may be approximately 10 inches in length by 1 inch in width and is welded to the back of a light sconce or fixture 2, although any known method of attachment (including adhesives) is within the scope of the present invention. A ½ inch diameter cut may be made into the middle of the bracket 14 to form notch 16. This ½ inch circle may fit securely on top of a standard jelly jar light fixture or other lamp. The light sconce or fixture 2 may be approximately 18 by 16 inches and made of metal, stainless or copper with various designs on the front. The bracket 14 may adjust to fit over a jelly jar light and the sconce/fixture 2 may be flush with the wall 24. A user could use a wire in the back versus a bracket 14 or a bolt system. A bracket 14 in the back of the light sconce/fixture 2 allows a user to secure the light sconce/fixture 2 onto a wall-mounted jelly jar light fixture or other lamp. The sconce designs range from plain to palm trees and cacti, etc. The light shines from the top and bottom as well as through the design/decoration 18, if any. The invention may include a bracket 14 in back of a light sconce/fixture 2 that fits securely onto an any existing outside jelly jar light, which turns a plain looking jelly light into a nice work of art.

We claim:

1. A method of decorating a lamp extending from a vertical wall, comprising:

providing a light fixture, the light fixture comprising:

a surface structure having a convex outer surface and a concave inner surface, the surface structure comprising first and second vertical side portions on opposing sides of a central apex portion, the first and second vertical side portions and central apex portion each extending along a vertical length of the surface structure; and a substantially band-shaped bracket having a first end attached to the first vertical side portion, a second end attached to the second vertical side portion, and a downward-facing support notch located substantially centrally along a length of the bracket; and installing the light fixture on a fixed lamp structure mounted to a wall lying in a first plane at least partially by:

lowering the notch of the bracket on an arm member of the lamp structure that projects outward from the wall substantially perpendicularly to the first plane and supports a lamp at a distal end of the arm member; and placing at least a portion of the first and second vertical side portions in contact with the wall, such that the surface structure is supported substantially exclusively by the bracket and the first and second vertical side portions.

2. The method of claim 1, wherein the light fixture is neither permanently attached to the lamp nor the wall, whereby the light fixture is configured to be removed from the lamp and wall by lifting the light fixture so that the arm member is no longer within the notch.

3. The method of claim 1, wherein the said installing is performed substantially without hardware.

4. The method of claim 1, wherein the light fixture has a horizontal cross sectional shape of a partial circle.

5. The method of claim 1, wherein the bracket comprises a flat metal strip extending between first and second vertical side portions of the surface structure.

6. The method of claim 1, further comprising removing the light fixture from the lamp and wall by lifting the light fixture so that the arm member is no longer within the notch.

7. The method of claim 1, further comprising adjusting the bracket so that when the notch of the bracket is on the arm member, the first and second side portions are substantially parallel with the wall.

8. The method of claim 7, wherein said adjusting comprises bending the bracket.

9. The method of claim 1, wherein the first vertical side portion, second vertical side portion and central apex portion are substantially parallel.

10. A light fixture for diffusing light from a wall-mounted lamp, comprising:

a surface structure having a convex outer surface and a concave inner surface, the surface structure comprising first and second vertical side portions on opposing sides of a central apex portion, the first and second vertical side portions and central apex portion each extending along a vertical length of the surface structure; and a bracket having a first end attached to the first vertical side portion, a second end attached to the second vertical side portion, and a downward-facing support notch located substantially centrally along a length of the bracket;

wherein the light fixture is configured to be installed on a lamp structure mounted to a wall lying in a first plane, the lamp fixture comprising an arm member that projects outward from the wall substantially perpendicularly to the first plane and supports a lamp at a distal end of the arm member; and wherein, when the light fixture is installed on the lamp structure, the notch is configured to rest on the arm member and at least a portion of the first and second vertical side portions contact the wall, such that the surface structure is supported substantially exclusively by the bracket and the first and second vertical side portions.

11. The light fixture of claim 10, wherein the bracket is configured to be bent in order to adjust a fit between the light fixture and the wall.

12. The light fixture of claim 10, wherein the bracket comprises an elongate substantially flat strip.

13. The light fixture of claim 10, wherein the bracket comprises a wire.

14. The light fixture of claim 10, wherein the surface structure and bracket comprise metal.

15. The light fixture of claim 10, wherein the surface structure has one or more perforations therein designed to allow light to shine therethrough.

16. The light fixture of claim 10, wherein the bracket is disposed on an upper half of the light fixture.

17. The light fixture of claim 10, wherein the first vertical side portion, second vertical side portion and central apex portion are substantially parallel.

* * * * *